US007604027B2

(12) United States Patent
Thatcher

(10) Patent No.: US 7,604,027 B2
(45) Date of Patent: Oct. 20, 2009

(54) RETRACTABLE WORKBENCH

(76) Inventor: John T. Thatcher, 6837 S. Magnolia Ct., Englewood, CO (US) 80112-1010

( * ) Notice: Subject to any disclaimer, the term of this patent is extended or adjusted under 35 U.S.C. 154(b) by 615 days.

(21) Appl. No.: 11/197,900

(22) Filed: Aug. 4, 2005

(65) Prior Publication Data

US 2007/0029011 A1 Feb. 8, 2007

(51) Int. Cl.
*B25H 1/16* (2006.01)
*B25H 1/18* (2006.01)
*A47B 3/08* (2006.01)

(52) U.S. Cl. ..... 144/286.5; 144/287; 108/36; 108/116; 108/166

(58) Field of Classification Search ..... 144/286.1, 144/286.5, 287; 108/33, 36, 66, 77, 115, 108/166, 116, 129
See application file for complete search history.

(56) References Cited

U.S. PATENT DOCUMENTS

| | | | | |
|---|---|---|---|---|
| 856,962 | A | 6/1907 | Kelly et al. | |
| 1,579,123 | A * | 3/1926 | McCabe | 38/139 |
| 4,155,609 | A | 5/1979 | Skafte et al. | |
| D263,533 | S | 3/1982 | Ferdinand et al. | |
| 4,919,498 | A * | 4/1990 | Turner | 312/241 |
| 5,170,719 | A | 12/1992 | Pestone | |
| 5,311,826 | A * | 5/1994 | Baggiani | 108/166 |
| 5,513,574 | A | 5/1996 | Collins | |
| 6,039,416 | A | 3/2000 | Lambert | |
| 6,161,486 | A | 12/2000 | Boots | |
| 6,786,162 | B1 * | 9/2004 | Volkmer et al. | 108/115 |
| 6,978,721 | B2 * | 12/2005 | Myers | 108/48 |
| 2004/0032190 | A1 | 2/2004 | Condas | |

* cited by examiner

*Primary Examiner*—Shelley Self
(74) *Attorney, Agent, or Firm*—Sheridan Ross P.C.

(57) ABSTRACT

A retractable workbench is provided that is mounted to a vertical surface such as a wall. The workbench is retractable between a horizontally oriented deployed position, and a vertically oriented retracted position. The workbench is vertically adjustable along wall mounts. Bench mounted tools may be mounted on rotatable panels, and the panels may be inverted when the workbench is retracted, thereby allowing the workbench to be fully rotated to the vertically oriented retracted position without removing the tools. Storage of tools and hardware may be achieved by a rotatable mounting surface that attaches to the workbench. Workbench legs that support the workbench when deployed are also retractable, and the legs may be adjusted for height and securely attached to the floor for additional stability.

11 Claims, 6 Drawing Sheets

RETRACTABLE WORKBENCH

FIELD OF THE INVENTION

The present invention relates to a retractable workbench, and more particularly, to a multi-featured retractable and adjustable workbench assembly that accommodates the mounting of objects such as bench top tools, and storage devices, such as pegboards and organizer cabinets.

BACKGROUND OF THE INVENTION

Various forms of retractable or pivoting workbenches are known in the art. The advantage of a retractable workbench is that it may be used in confined spaces where the workbench cannot be permanently deployed. One example of a wall-mounted workbench includes the invention shown in U.S. Pat. No. 5,513,574. This workbench is in the form of a folding bench cabinet apparatus having a base cabinet with a pair of folding doors secured to a base cabinet. The base cabinet includes a bench assembly that is pivotally mounted to the base cabinet, and a pair of folding legs that enable the bench to remain deployed.

Another example of a retractable or pivoting workbench is shown in U.S. Pat. No. 6,039,416. This workbench comprises a fixed tool storage housing mounted on a wall, and a pivotal workbench having retractable and lockable legs. Operative latching members are provided between the tool storage housing and pivotal workbench to temporarily secure the assembly to the wall.

Another example of a retractable workbench includes the invention described in U.S. Publication No. US2004/0032190. This device is a portable wall mountable storage cabinet adapted for storing tools and other items, including a drop-down storage bench that secures stored items within the cabinet when the bench is not deployed, and a pair of pivoting and telescoping legs that are hingedly attached to an exterior of the storage bench.

While each of these prior art inventions may be adequate for their intended purposes, there is still a need for a retractable workbench that may be used in confined spaces, such as a small garage, yet can provide the user with additional capabilities for not only storage of hardware and tools, but also for accommodating permanent mounting of power tools, vises or other bench mounted objects.

SUMMARY OF THE INVENTION

In accordance with the present invention, a retractable workbench assembly is provided that is preferably mounted to a vertical surface such as a wall. The workbench assembly includes a pair of wall mounts spaced apart from one another and directly mounted to the wall. A workbench surface is mounted to the wall mounts to produce an apparatus that allows for bench rotation. A pair of retractable and telescoping legs is mounted to a forward or front edge of the bench. In conjunction with the telescoping legs, the wall mounts also provide vertical adjustment capability for a particular desired height of the bench. In operation, a user sets the bench at the desired height, and then rotates the bench into the deployed or horizontal position. In the deployed or horizontal position, the working surface of the bench can be adjusted to a level working surface or to an angled working surface by then adjusting the height of the telescoping legs. In the retracted position, the bench rotates upward to a vertical position adjacent to the wall, and means are provided for securing the front edge of the bench thus maintaining the bench in the retracted position. The retractable legs rotate downward and fit within the structural framework of the workbench so as to provide a very non-intrusive profile for the workbench when in the retracted position.

A planar mounting surface such as a pegboard has an upper end rotatably secured to the bench. When the bench is deployed in the horizontal position, the pegboard hangs in a vertical orientation below the bench. When the bench is retracted, the pegboard also rotates and maintains a vertical orientation, but against the lower exposed surface of the bench. In either the retracted or deployed position of the bench, a user may use the pegboard for storage of various items such as hand tools. In lieu of a pegboard, the user may choose to have an organizer cabinet attached to the planar mounting surface. Thus, in either the retracted or deployed position of the bench, a user may access the organizer cabinet.

To accommodate the mounting of objects such as bench top tools, one or more rotationally mounted panels may be incorporated with the bench enabling a user to directly mount a bench top tool such as a grinding wheel or some other bench mounted tool such as a vise. The panels may be incorporated as overhangs on the side edges of the bench, or may be incorporated within the center area of the bench. Larger bench top tools, such as an electric miter saw or sewing machine can be directly mounted to a panel within the center area of the bench. Smaller mountable tools can be mounted directly to a side panel. When the bench is retracted, each rotationally mounted panel is inverted by rotating the panel about a central pin that extends substantially parallel to a plane of the bench. One or more locking pins can be used to maintain each panel in either the normal or inverted positions. Similarly with the mounting of larger bench top power tools directly to the center area of the bench, when the bench is retracted, the center panel is inverted by rotating the center panel about a central pin that traverses the framework of the bench parallel to a plane of the bench. Accordingly, when the bench is retracted, all bench-mounted tools may remain attached to the bench and the tools do not interfere with full rotation of the table to a vertical, storage position against the wall.

In order to facilitate vertical adjustment of the bench within the wall mounts, a pair of roller assemblies are used to connect the rotatable end of the bench to the wall mounts. The roller assemblies each include rollers which roll along tracks within the wall mounts. A latch mechanism is integrated with each roller assembly. Each latch mechanism includes a handle portion that allows a user to rotate the latch mechanism in and out of engagement with a selected height peg or pin that extends from each wall mount. In order to adjust the height of the bench, the bench is first retracted, the user grasps the handle portions of each latch, disengages the latches from the present pin locations by rotating the handles, lifts or lowers the bench to the desired height, and then reengages the latches with the desired height pins by rotation of the handles in the opposite direction. The user then adjusts the telescoping legs to the same height as the bench and wall mount for a level working surface or to a height less than that of the bench and wall mount for an angled working surface. An angled working surface may be advantageous for use of the workbench as a drafting table.

Various other features and advantages of the present invention will become apparent from a review of the following detailed description taken with the drawings.

DETAILED DESCRIPTION OF THE DRAWINGS

Figure 2:
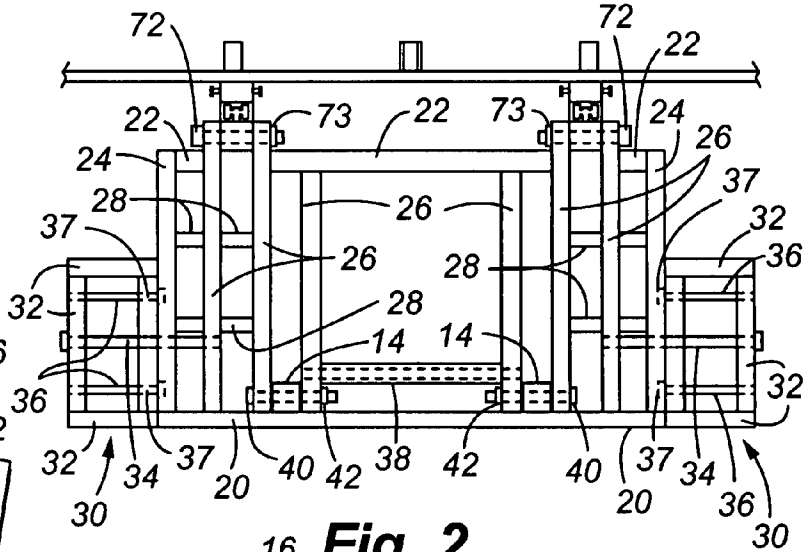
FIG. 2 is a top plan view of the workbench with the workbench surface removed to view the structural framework of the workbench.
Figure 3:
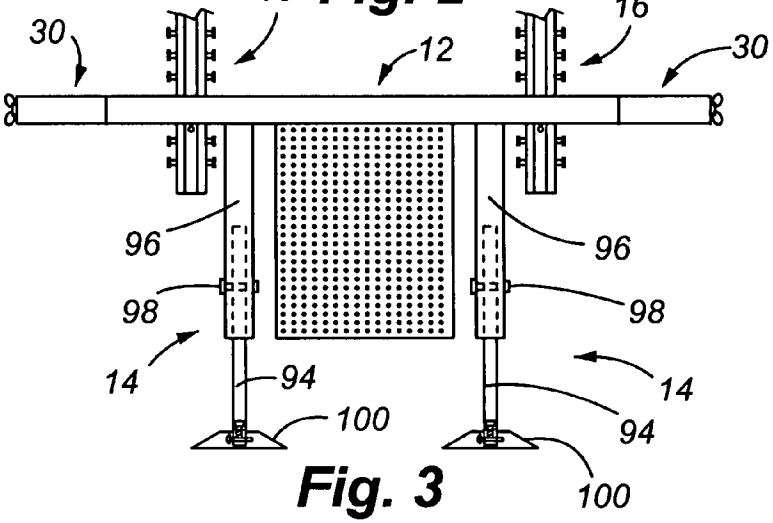
FIG. 3 is a front elevation view of the workbench.
Figure 1:
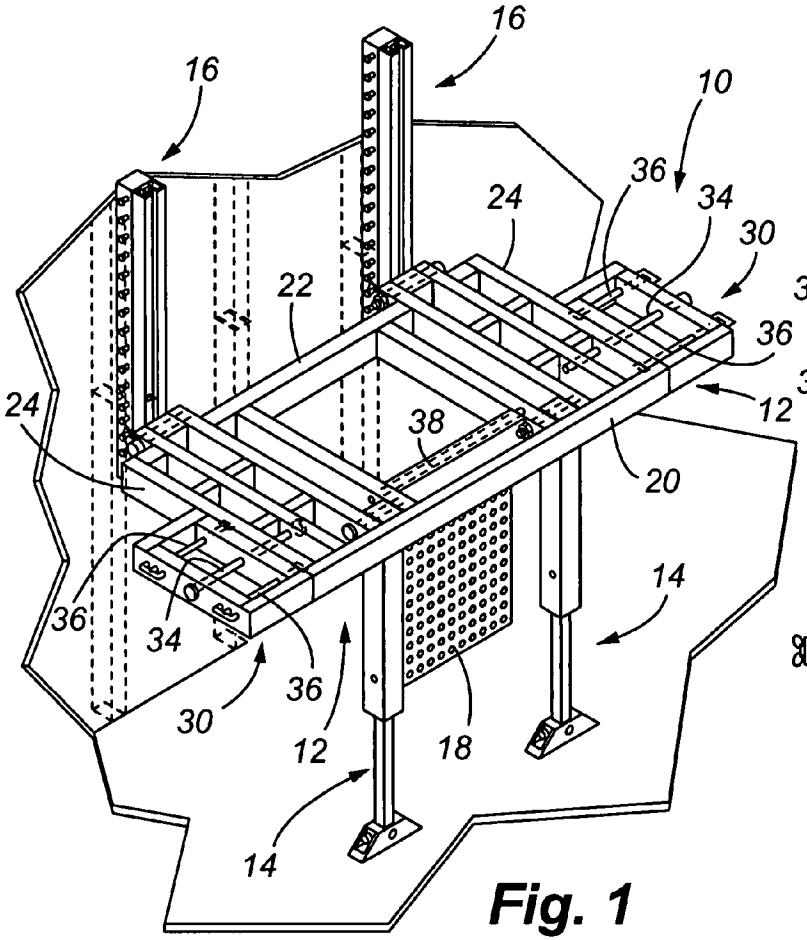
FIG. 1 is a perspective view of the workbench of the present invention deployed in the horizontal or extended position and with the workbench surface removed to view the structural framework of the workbench.

Referring to FIGS. 1-3, the retractable workbench 10 of the present invention is illustrated. The basic parts or components of the workbench assembly include a table or bench 12 that is rotatably mounted to a pair of wall mounts 16, and a pair of retractable and telescoping legs 14 which are attached adjacent the front edge of the bench. A planar mounting surface, such as a pegboard 18, has an upper end that is rotatably mounted to the bench 12 and hangs below the bench when the bench is deployed to the horizontal position. In all of the figures, the working surface of the bench 12 has been removed in order to be able to view the components of the workbench. The working surface could include a piece of plywood/composite board, or any other suitable surface material.

Figure 4:
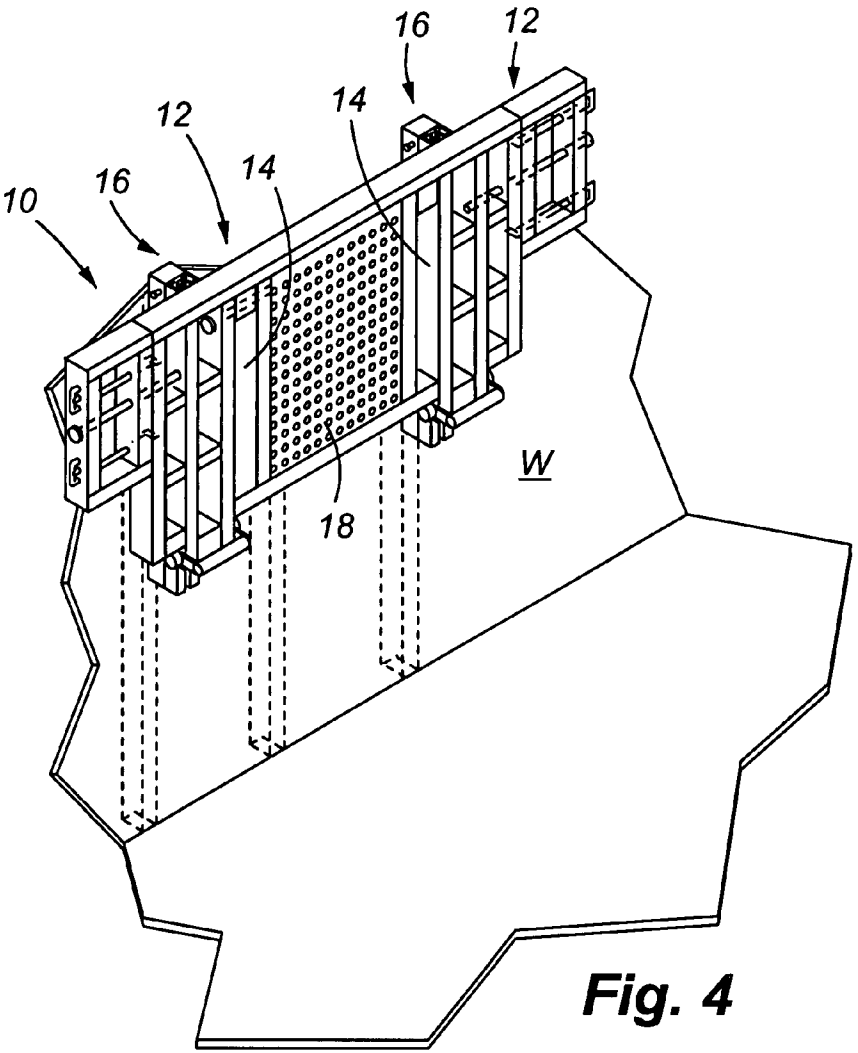
FIG. 4 is a perspective view of the workbench in the retracted position.

Referring to FIG. 4, when the bench is retracted, the pegboard 18 rotates so that it lies flush against the structural framework on the lower exposed side of the bench. The legs 14 rotate downward as shown and also lie flush against the structural framework of the bench. Thus, the bench maintains a very non-intrusive profile when placed in the retracted position.

Referring now to FIGS. 2 and 3, other structural details of the invention will be described. Beginning first with FIG. 2, a plurality of supports or studs are illustrated which define the structural framework for the bench. As shown, there is a front edge support 20, rear edge supports 22, and a pair of lateral side edge supports 24. There is also provided a plurality of interior support studs 26, and a plurality of lateral support studs 28. Those skilled in the art can envision any number of different ways in which supports 20-28 may be provided to ensure the bench 12 has adequate structural support, depending upon the intended use of the bench. A pair of rotationally mounted panels 30 are provided at each lateral edge of the bench 12. The panels 30 also include various supports such as overhang supports 32 that traverse around the peripheries of the panels 30. Each rotationally mounted panel 30 also comprises one or more locking pins 36 that extend through the pair of overhang supports 32 extending transversely with respect to the length of the bench. The locking pins 36 may be spring biased so that the user may disengage the locking pins 36 from their locked position, for example, by depressing a button located on the free end (not shown) which disengages the opposite end of the pin from within the respective openings 37 formed inside edge studs 24. Alternatively, the pins 36 may simply be secured to the panels 30 as by wing nuts, the pins 36 each having the free end being threaded and extending beyond a lateral edge of the corresponding panel, and having an opposite end secured to the opposite lateral edge. Those skilled in the art can envision a number of different arrangements with respect to the pins 36 and how the pins can be used to detachably secure the panels 30. Each panel 30 is rotatable about a center rotation pin 34 which extends through the panel 30, through both side edge studs 24, and through the interior support studs 26, as shown. A sleeve or bushing (not shown) may surround each pin 34 thus providing a guide for removal and insertion of the pins to lock or unlock the panels 30. As discussed further below, when a user desires to place the bench in the retracted position, the user would disengage and/or remove the securing pins 36, and rotate the panels about their respective rotation pins 34 so that the lower surfaces of the panels were placed flush with the upper surface of the bench. Then, the user would reattach the securing pins thus securing the mounted tools in their inverted positions.

The pegboard 18 is rotatable about a pegboard rotation rod 38 that is secured between the most interior pair of interior support studs 26. The upper end of the pegboard which attaches to the rotation pin 38 can include various configurations, to include an integral tube or sleeve (not shown) mounted to the upper end of the pegboard which receives the rotation rod 38.

As also seen in FIG. 2, the upper ends of the legs 14 are attached to the bench as by bolts 40 and nuts 42. Openings are formed through the upper ends of the legs 14 to receive the bolts 40. As desired, a sleeve or bushing (not shown) can also be placed within each opening in the legs to receive the bolts 40, thereby ensuring smooth rotational capability of the legs.

Figure 5:
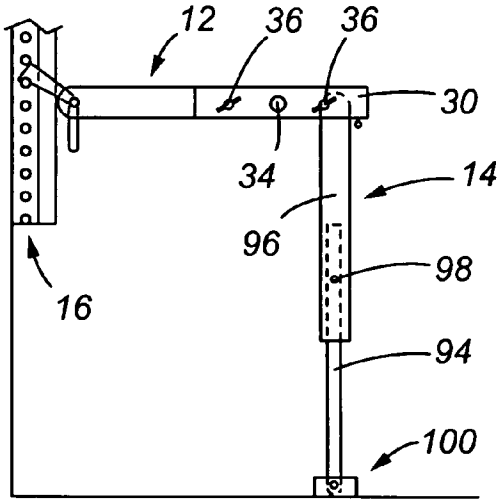
FIG. 5 is a side view of the workbench.
Figure 6:
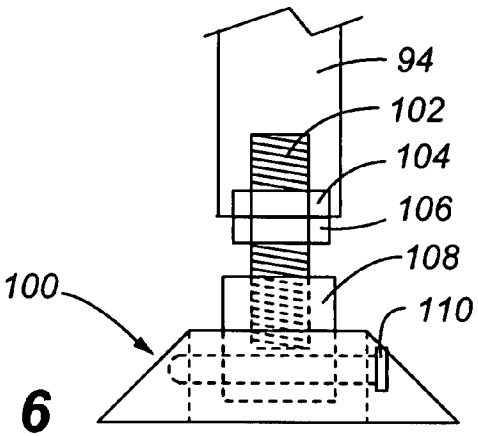
FIG. 6 is an enlarged elevation view showing details of the feet and legs.

Now referring to FIGS. 3, 5 and 6, additional structural details of the legs 14 are shown. Each leg includes both a receiver 96 and a telescoping extension 94. Pins 98 are used to adjust the lengths of the telescoping extensions 94, a plurality of openings being formed on receivers 96 which are alignable with holes formed on the telescoping extensions 94.

In order to provide greater stability and micro adjustments for leveling the working surface, feet 100 may also be used in conjunction with the legs 14. FIG. 6 illustrates one of the feet 100. A nut 104 can be secured within the distal or lower end of the telescoping extension 94. A threaded bolt 102 can be threaded through the nut 104, and an intermediate locking nut 106. A threaded base 108 can receive the free end of the bolt 102. Nut 106 would be tightened against nut 104 to prevent any rotation of bolt 102. Base 108 is then received within a central slot or channel formed in the foot 100. An interference fit can be used to secure the base 108 to the foot 100. Optionally, a laterally extending pin 110 may be used to secure the base to the foot 100.

Figure 7:
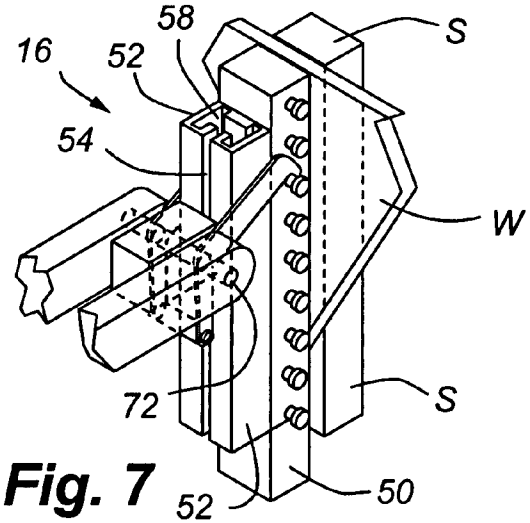
FIG. 7 is an enlarged fragmentary perspective view of the details of a latch mechanism and a wall mount wherein the latch mechanism is engaged with the wall mount.
Figure 8:
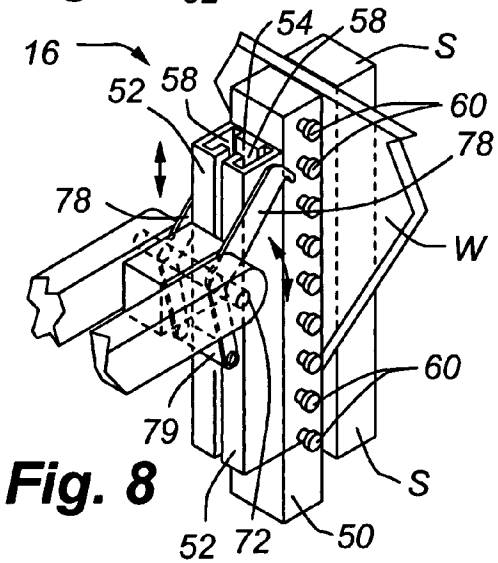
FIG. 8 is another enlarged fragmentary perspective view of the latch mechanism and wall mount showing the latch disengaged allowing the workbench to be raised or lowered.

Referring to FIGS. 7 through 11, the details of how the bench is mounted to a wall are shown. FIGS. 7 and 8 shows that each wall mount 16 includes a mounting stud 50 that is secured directly to the wall W, and preferably directly into the studs S which support the wall W. Each mounting support 16 also includes a frame 52 which mounts directly to the corresponding mounting stud 50. Each frame 52 has a central channel 54 formed along its length. Each channel 54 includes a pair of roller tracks 58 which enable a main roller assembly 62 (FIGS. 9 and 10) to travel therethrough, as discussed below. A plurality of vertical positioned pegs 60 extend laterally away from the mounting studs 50. A user can select a particular height at which the bench is to be placed by selecting pairs of the positioning pegs 60, as further discussed below. As seen in FIGS. 2 and 3, the positioning pegs 60 extend from both the inner and outer lateral sides of the mounting studs 50.

Figure 9:
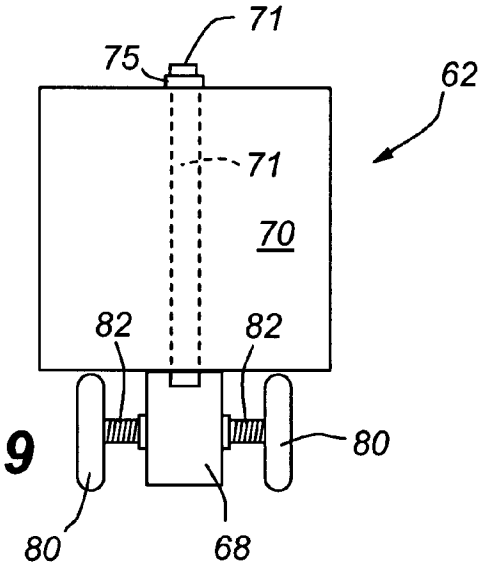
FIG. 9 is a lower plan view showing details of one of the main roller assemblies.
Figure 10:
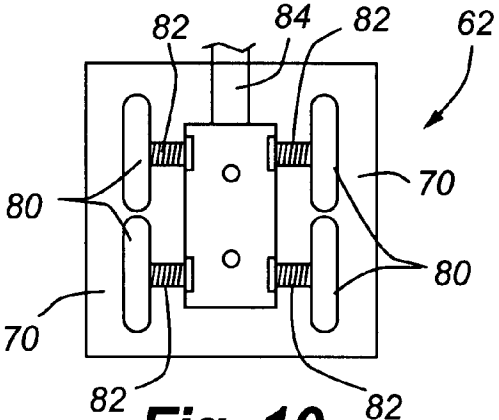
FIG. 10 is a rear elevation view of one of the main roller assemblies.

Now also referring to FIGS. 9 and 10, the main roller assemblies 62 are illustrated in more detail. The main roller assemblies allow the bench to remain connected to the frames 52, but also allow the bench to be selectively placed at a desired height. The main roller assemblies 62 each include a roller block 68 that preferably has two pairs of rollers 80 attached thereto. Rollers 80 are attached to each roller block 68 by respective axles 82. The front or exposed edge of each roller block 68 is substantially flush with the opening formed at channel 54. A roller block support 70 attaches to each roller block 68, as by a mounting bolt 71 and nut 75. An opening is formed transversely through the block supports 70, and a bench rotation rod or pin 72 extends horizontally through the opening. The bench is rotatable about the rotation pins 72. The bench rotation pins 72 may be secured as by nuts 73, as shown in FIG. 2. It may also be desirable to first place a bushing or collar (not shown) through the openings in the block supports 70 that thereby allows rotation of the bench around the rotation pins 72 with less frictional resistance.

A latch assembly 74 is also mounted to each rotation pin 72, each latch assembly including a handle 79 which extends downwardly away from the pin 72, and a hook portion 78 which is used to secure the bench at a desired height by engagement of the hook portion 78 with the selected pegs 60. The handles are attached to the underside of the bench by the pins 72, and the handles are rotatable about the pins as shown. When it is desired to change the height of the bench, a user would grasp both of the handles 79, rotate the handles 79 so that the respective hook portions 78 are rotated out of engagement with the positioning pegs 60, and then raise or lower the bench to the desired height. Finally, the user would then rotate the handles 79 so that the hook portions 78 again engaged the selected pair of positioning pegs.

Figure 11:
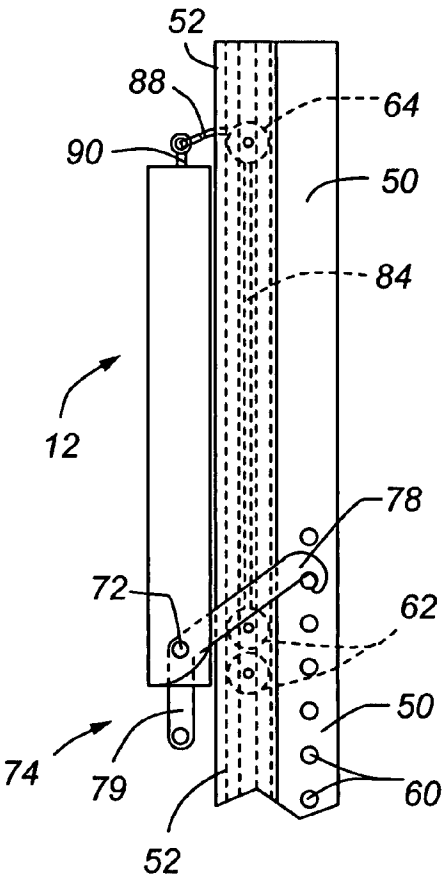
FIG. 11 is an enlarged fragmentary side view illustrating the workbench in the retracted position.
Figure 12:
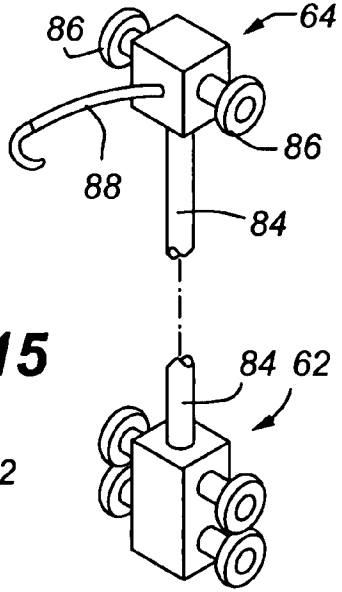
FIG. 12 is an exploded perspective view showing a main roller assembly and an upper roller assembly connected by a rod.
Figure 18:
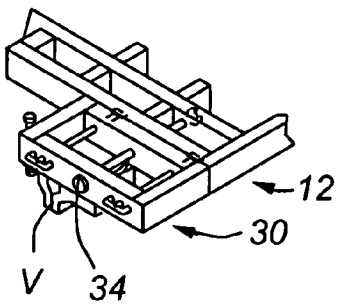
FIGS. 15-18 illustrate the rotation of a bench top mounted tool on a rotationally mounted side panel and from the deployed or operational position to an inverted position allowing the workbench to be fully retracted.

In addition to the main roller assemblies 62, upper roller assemblies 64 may be provided. Referring to FIGS. 11 and 12, the upper roller assemblies 64 preferably only have a pair of rollers 86. Upper roller assemblies 64 are spaced above the main roller assemblies 62. Each upper roller assembly 64 also travels within the tracks 58 of the supports 16. A rigid rod 84 interconnects each main roller assembly 62 with an upper roller assembly 64. The spacing between the main roller assemblies and the upper roller assemblies is substantially the same as the width of the bench. Bench retaining members 88 connect to the corresponding upper roller assemblies 64 and protrude outwardly from each channel 54. The bench retainers may have hooked ends that are received in eyes 90 attached to the side edge of the bench. Thus, regardless of the specific height chosen for the bench, the bench retainers 88 are available for securing the bench in the retracted position.

Figure 13:
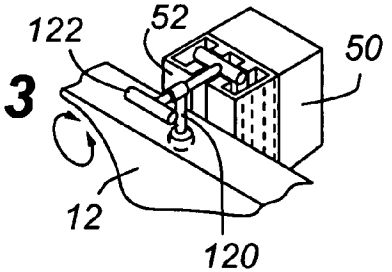
FIG. 13 is an enlarged fragmentary perspective view of an alternate means to connect the workbench to the wall mount when the workbench is retracted.
Figure 15:
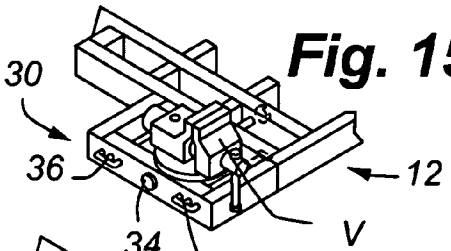
Figure 16:
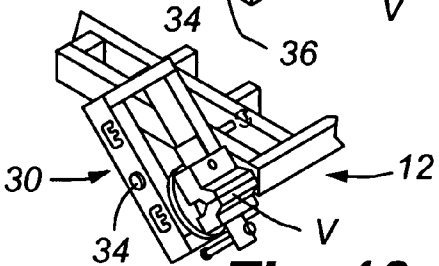
Figure 17:
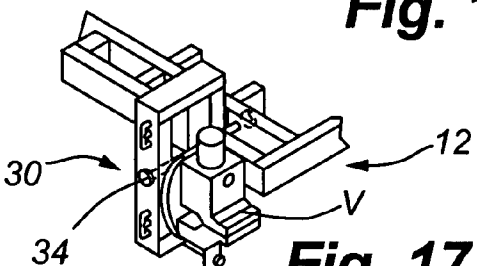

Referring to FIG. 13, an alternate means of attaching the bench to the wall mounts is shown. In lieu of an upper roller assembly with a bench retaining member, the side edge of the bench may simply include an "H" shaped member 120 rotatably mounted to an extension 122. When it is desired to secure the bench to the wall mount, the member 120 is rotated to a vertical orientation so the member 120 may be inserted into the track. The member 120 is then rotated 90 degrees to the position shown in FIG. 13 so the transverse extension of the member is retained in the track 58. A pair of H shaped member 120 may be used for securing the bench to each wall mount.

Figure 14:
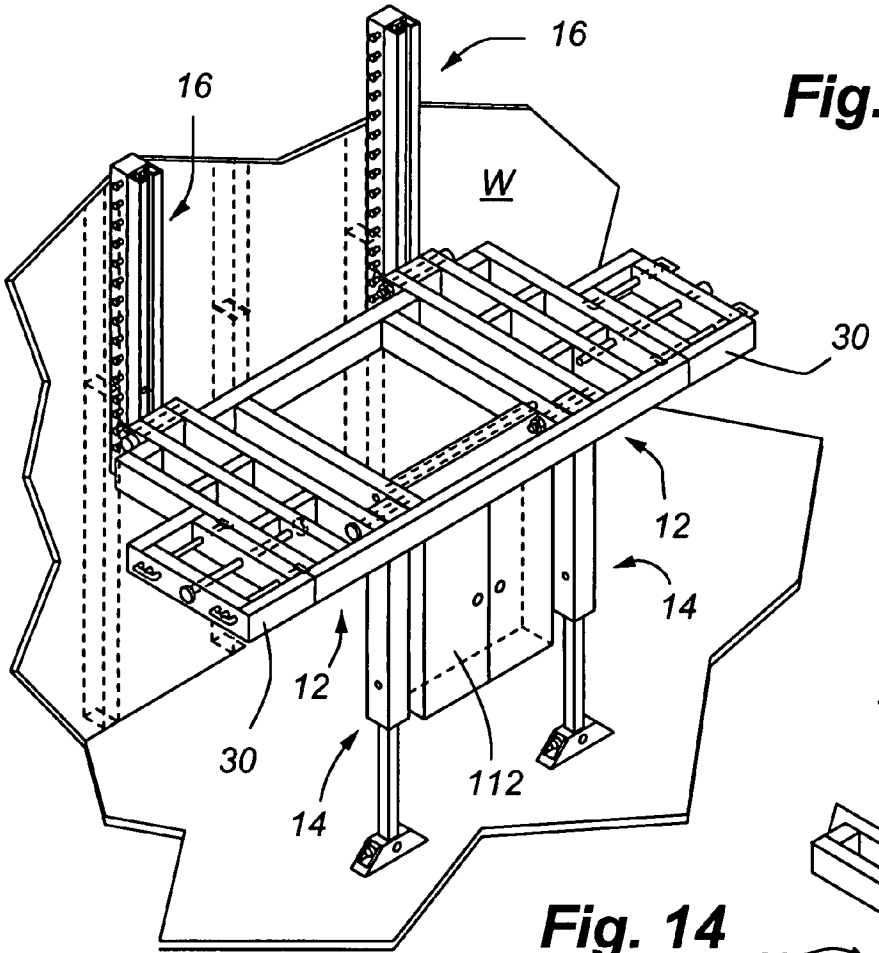
FIG. 14 is a perspective view of another embodiment of the present invention illustrating use of an organizer cabinet in lieu of a pegboard.

Referring to FIG. 14, an alternate embodiment is shown wherein the pegboard is replaced in favor of another type of storage unit such as an organizer cabinet 112. Like the pegboard, the cabinet 112 also hangs under the bench and rotates when the bench is retracted. The upper end of the organizer cabinet attaches to the rotation rod 38 enabling the cabinet to freely rotate. Those skilled in the art can envision any number of different types of storage devices that can be rotatably attached to the bench enabling a user to store tools or hardware.

Referring to FIGS. 15-18, one of the panels 30 is shown as having a vise mounted thereto. When it is desired to place the bench 12 in the retracted position, the panels 30 can be rotated to a reversed position or inverted position with respect to the bench so that the flat lower surfaces of the panels become flush with the upper surface of the bench, thereby allowing the entire bench to be rotated to the vertical position without interference by the bench mounted tools. In the example of FIGS. 15-18, a user first releases or disengages the locking pins 36, rotates the bench mounted tool the inverted position, and then replaces the locking pins to secure the tool in the inverted position.

It should also be understood that a single wall mount could be used in lieu of a pair of wall mounts. More specifically, a single wall mount could be located at the center of the workbench, and the table would be rotated about this single wall mount. This alternative arrangement may be suitable for lighter and less strenuous uses of the workbench. For example, if it was not necessary to permanently mount relatively heavy bench mounted tools, or the workbench would not be used to support heavy items, then a single wall mount may be adequate.

Figure 19:
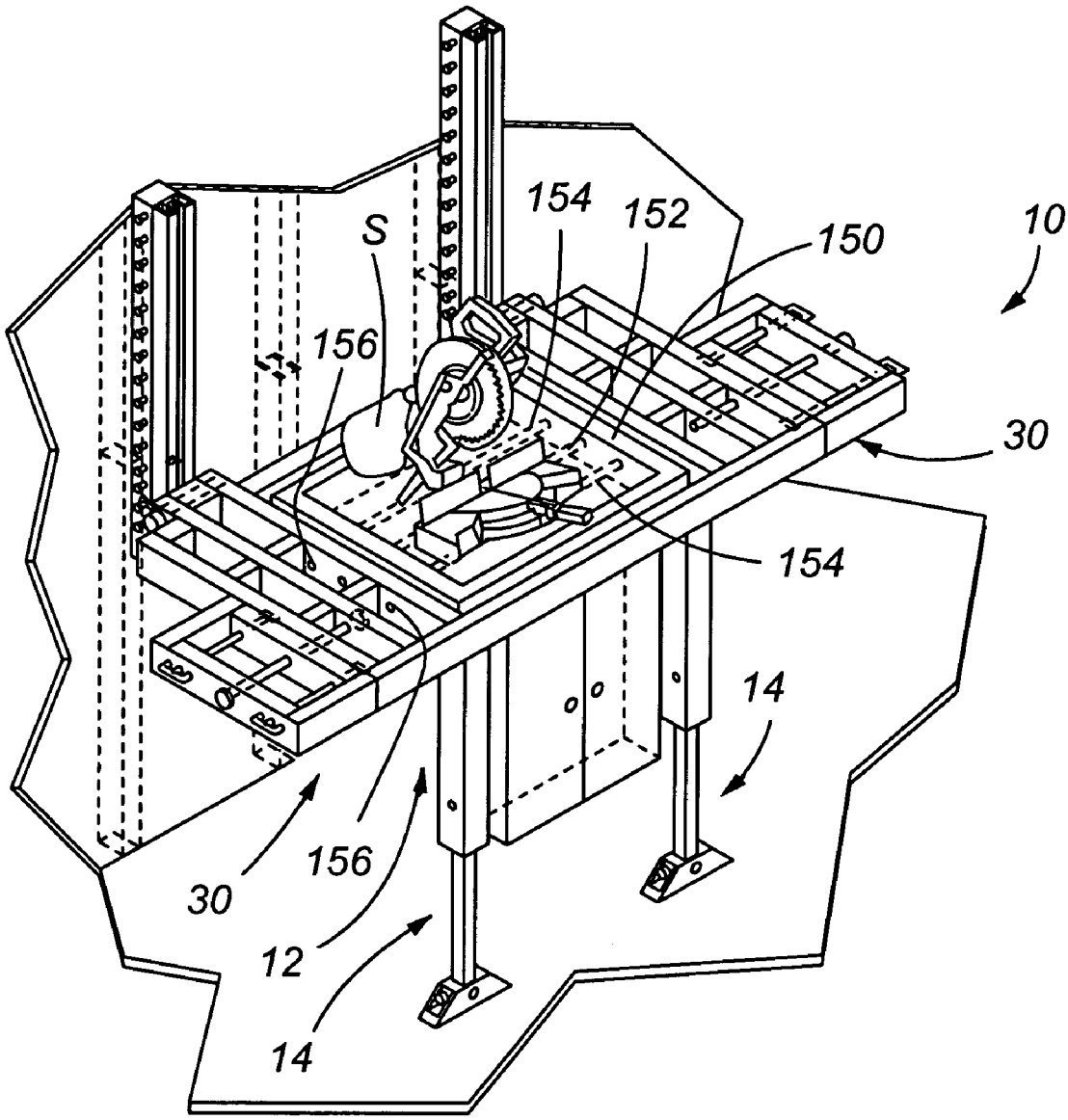
FIGS. 19 and 20 illustrate the rotation of a bench top mounted tool mounted on a rotationally mounted center panel.
Figure 20:
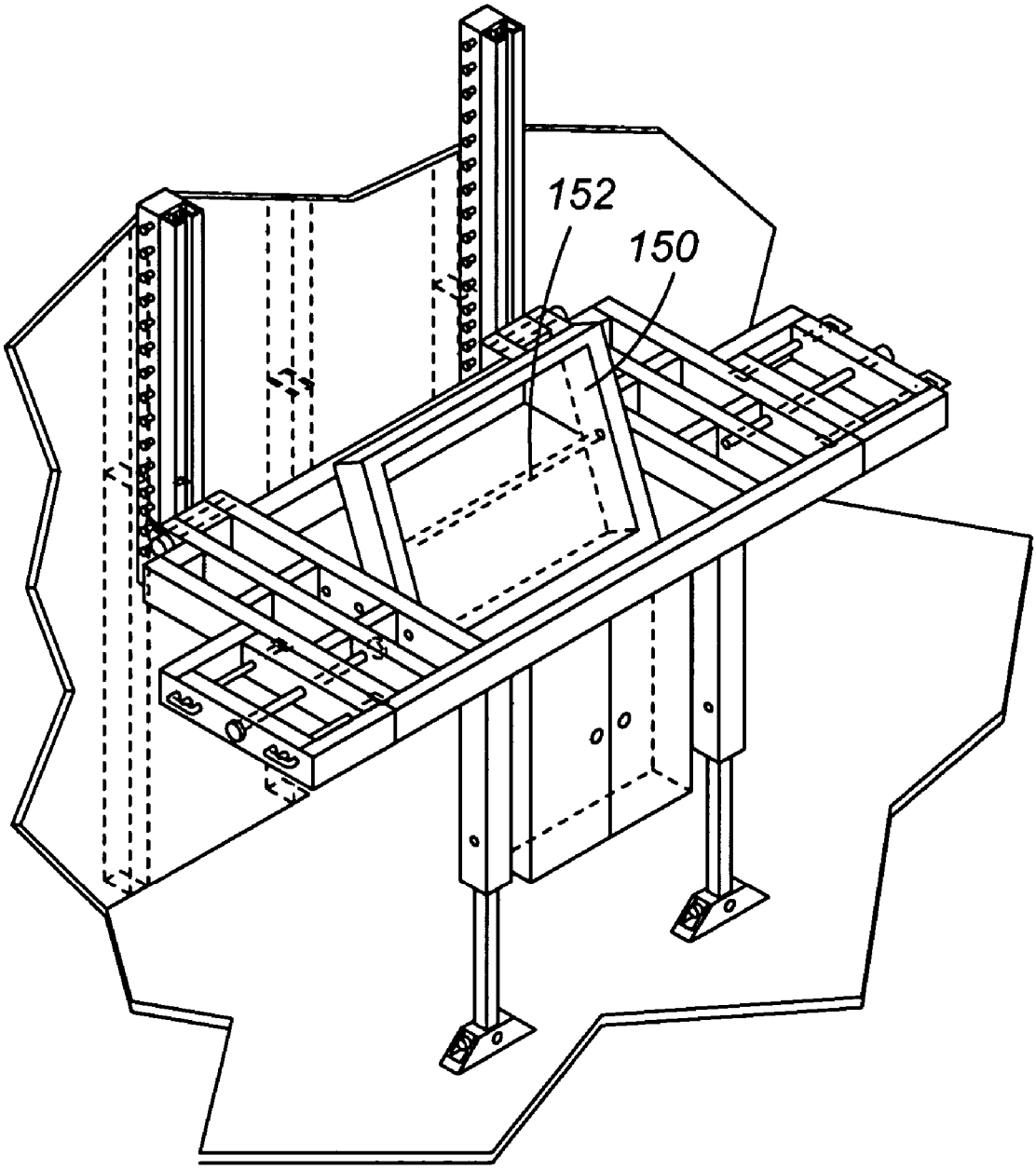

Referring to FIG. 19, another embodiment of the present invention is illustrated. In this embodiment, a center rotatable panel 150 is shown wherein another bench mounted tool such as a saw S is mounted to an upper surface of the center panel. A center rotation pin/rod 150 and a pair of outer securing pins/rods 154 maintain the center panel in a flush position. Pins/rods 154 are secured through openings 156 formed on the supports adjacent to the center panel 150. Depending upon the size of the saw or other bench mounted tool, the cabinet 112 could be removed as necessary. In order to rotate the center panel, the exterior securing pins/rods 154 are removed, and the center panel is rotated about the rotation pin/rod 152. Thus, the center panel provides further rotational capability for other tools mounted to the workbench. FIG. 20 more specifically illustrates rotation of the center panel, the saw S being removed for clarity of illustration.

By the foregoing, it is clear that the retractable workbench of the present invention provides a user with many advantages. The workbench is directly mountable to a vertical surface such as a wall, and the workbench can be retracted to a vertical position flush with the wall. The rotationally mounted panels allow a user to mount traditional bench mounted tools to the bench, yet the bench-mounted tools do not interfere with the capability of the bench to be fully rotated to the retracted position. Additional storage of tools or hardware is incorporated directly within the workbench by use of a planar mounting surface which is rotatably mounted to the bench, and is also retractable with the bench. The ability to also raise or lower the workbench to a desired height also enhances use of the workbench for various types of uses.

Although the present invention has been illustrated with respect to preferred embodiments, it shall be understood that various other changes and modifications may be made to the invention which fall within the scope of the claims appended hereto.

What is claimed is:

1. A retractable workbench comprising:

a pair of wall mounts spaced from one another and mounted to a wall;

a bench having a first end rotatably mounted to said wall mounts, and having a second end extending away from said wall mounts, said bench being selectively movable between a retracted position wherein the bench is aligned substantially vertical, and an extended position wherein said bench extends substantially horizontal;

a pair of retractable legs rotatably connected to said second end of said bench; and a rotationally mounted panel attached to said bench, said rotationally mounted panel being rotatable between a first position wherein an upper surface of said rotationally mounted panel is substantially planar with an upper surface of said bench, and an inverted second position wherein a lower surface of said rotationally mounted panel is substantially planar to said upper surface of said bench, said rotationally mounted panel being rotatable about an axis extending substantially parallel to a plane of the bench.

2. A workbench, as claimed in claim 1, wherein:

said rotationally mounted panel includes a rotation pin about which said rotationally mounted panel rotates between the first and second positions, and at least one removable fastener interconnecting said rotationally mounted panel and said bench.

3. A workbench, as claimed in claim 1, wherein:

said rotationally mounted panel is secured to a lateral side edge of said bench.

4. A workbench, as claimed in claim 1, wherein:

each leg includes a receiver portion and a telescoping portion selectively extendable with respect to said receiver portion.

5. A workbench, as claimed in claim 1, wherein:

each leg further includes a foot attached thereto.

6. A workbench, as claimed in claim 1, further including:

a first roller assembly mounted in each said wall mount, and a latch integral with each roller assembly for selectively positioning a height of said workbench with respect to said wall mounts by lifting or lowering the bench thus moving the roller assemblies within the wall mounts.

7. A workbench, as claimed in claim 6, wherein:

said latch includes a handle portion rotatably communicating with said first rotatable end of said bench, and a hook portion extending from said handle and selectively engageable with selected height adjustment means formed on said wall mounts.

8. A workbench, as claimed in claim 1, further including:

means attached to at least one of said wall mounts for securing the second end of the bench when said bench is placed in the retracted position.

9. A workbench, as claimed in claim 6, further including:

a second roller assembly mounted in one of said rail supports and vertically spaced from said first roller assembly, a rod interconnecting said first roller assembly and said second roller assembly, and a bench capturing means extending from said second roller assembly for capturing said second end of said bench when said bench is placed in the retracted position.

10. A workbench, as claimed in claim 1, further including:

a planar member having an upper end rotatably connected to said bench, and rotatable between a first substantially vertical hanging position under said bench, and a second substantially vertical hanging position adjacent a lower surface of said bench when said bench is rotated to the retracted position.

11. A workbench, as claimed in claim 1, further including:

an organizer cabinet having an upper end rotatably connected to said bench, and rotatable between a first substantially vertical hanging position under said bench, and a second substantially vertical hanging position adjacent a lower surface of said bench when said bench is rotated to the retracted position.

* * * * *